US011499749B2

(12) United States Patent
He et al.

(10) Patent No.: US 11,499,749 B2
(45) Date of Patent: Nov. 15, 2022

(54) HEATING BLOWER AND HEATING DEVICE

(71) Applicant: JIANGMEN KEYE ELECTRIC APPLIANCES MANUFACTURING CO., LTD, Jiangmen (CN)

(72) Inventors: Xiangming He, Guangdong Provine (CN); Guanglian Lin, Guangdong Provine (CN)

(73) Assignee: JIANGMEN KEYE ELECTRIC APPLIANCES MANUFACTURING CO., LTD, Jiangmen (CN)

( * ) Notice: Subject to any disclaimer, the term of this patent is extended or adjusted under 35 U.S.C. 154(b) by 1023 days.

(21) Appl. No.: 16/202,597

(22) Filed: Nov. 28, 2018

(65) Prior Publication Data

US 2020/0072498 A1 Mar. 5, 2020

(30) Foreign Application Priority Data

Aug. 30, 2018 (CN) ..... 201811001080.7
Aug. 30, 2018 (CN) ..... 201811001086.4

(51) Int. Cl.
*F24H 3/04* (2022.01)
*F24H 9/1863* (2022.01)
(Continued)

(52) U.S. Cl.
CPC ..... *F24H 3/0417* (2013.01); *F04D 13/06* (2013.01); *F04D 29/403* (2013.01);
(Continued)

(58) Field of Classification Search
None
See application file for complete search history.

(56) References Cited

U.S. PATENT DOCUMENTS 960,815 A 6/1910 Carlisle
D152,778 S 2/1949 Fox
(Continued)

FOREIGN PATENT DOCUMENTS

CN 2811632 8/2006
CN 105020159 A 11/2015
(Continued)

OTHER PUBLICATIONS

8-Air VP-25 1 /4 HP 900 CFM Air Mover for Water Damage Restoration Equipment Carpet Dryer Floor Blower Fan Home and Plumbing Use, date first available Mar. 25, 2016, site visited Jun. 29, 2019.

(Continued)

*Primary Examiner* — Thor S Campbell
(74) *Attorney, Agent, or Firm* — Innovation Capital Law Group, LLP; Vic Lin

(57) ABSTRACT

Provided is a heating blower, comprising an air duct, a motor and a wind wheel arranged in the air duct, and a heating device arranged at a first air outlet of the air duct; the wind wheel is fixed to a rotating shaft of the motor; the heating device comprises a housing, an electric heater and a moving assembly; the housing is sleeved on the first air outlet, forming an inner chamber, which comprises a first area facing directly to the first air outlet and a second area not facing directly to the first air outlet; the electric heater is arranged on the moving assembly, and moves between the first area and the second area along with the moving assembly, so that an airflow blown from the first air outlet switches between a state of passing the electric heater and a state of not passing the electric heater, and is blown out from a second air outlet provided at the housing.

20 Claims, 12 Drawing Sheets

(51) Int. Cl.

| | |
|---|---|
| ***F04D 13/06*** | (2006.01) |
| ***F04D 29/40*** | (2006.01) |
| ***F24H 9/02*** | (2006.01) |
| ***F04D 29/42*** | (2006.01) |
| ***F04D 29/58*** | (2006.01) |

(52) U.S. Cl.
CPC ..... *F04D 29/4226* (2013.01); *F04D 29/582* (2013.01); *F24H 9/02* (2013.01); *F24H 9/1863* (2013.01)

(56) References Cited

U.S. PATENT DOCUMENTS

| | | | | |
|---|---|---|---|---|
| 3,725,640 | A * | 4/1973 | Kunz | F24H 3/0417 415/121.2 |
| 4,377,107 | A | 3/1983 | Izumi | |
| D269,116 | S | 5/1983 | Armbruster | |
| 4,424,006 | A | 1/1984 | Armbruster | |
| 4,476,773 | A | 10/1984 | Fehr | |
| 4,483,664 | A | 11/1984 | Armbruster | |
| 5,048,202 | A | 9/1991 | Shero | |
| 5,174,048 | A | 12/1992 | Shero | |
| 5,197,112 | A * | 3/1993 | Cameron | H05B 3/14 219/505 |
| D340,326 | S | 10/1993 | Genovese | |
| 5,265,895 | A | 11/1993 | Barrett | |
| 5,555,643 | A | 9/1996 | Guasch | |
| D482,772 | S | 11/2003 | Dooley | |
| 6,821,095 | B2 | 11/2004 | Dooley et al. | |
| 6,950,606 | B2 * | 9/2005 | Logan | F24H 3/0405 392/360 |
| D512,500 | S | 12/2005 | Wilson, Jr. | |
| D512,501 | S | 12/2005 | Wilson, Jr. | |
| D517,677 | S | 3/2006 | Bartholmey | |
| 7,050,707 | B1 * | 5/2006 | Lin | F24F 3/1423 392/347 |
| 7,088,913 | B1 * | 8/2006 | Verhoorn | F24H 3/0411 392/360 |
| D530,002 | S | 10/2006 | Ching | |
| 7,184,655 | B2 * | 2/2007 | Dehli | A47C 16/02 34/90 |
| D566,823 | S | 4/2008 | Lewis | |
| 7,355,146 | B2 * | 4/2008 | Angelis | B60H 1/2225 219/202 |
| D594,962 | S | 6/2009 | Lewis | |
| D596,283 | S | 7/2009 | Martinez et al. | |
| 7,664,378 | B2 * | 2/2010 | Gao | F04D 17/04 392/347 |
| 7,699,580 | B2 | 4/2010 | Lasko et al. | |
| 8,235,686 | B2 | 8/2012 | Wark | |
| D687,137 | S | 7/2013 | Nemes | |
| D698,433 | S | 1/2014 | Tomasiak et al. | |
| D704,908 | S | 5/2014 | Cui | |
| 8,768,151 | B2 * | 7/2014 | Tai | F24H 9/0057 392/360 |
| 9,194,603 | B2 * | 11/2015 | Yuan | F04D 25/14 |
| 9,395,100 | B2 * | 7/2016 | Crowe | F24H 3/0417 |
| D810,269 | S | 2/2018 | Sanders et al. | |
| D836,766 | S | 12/2018 | He et al. | |
| D837,360 | S | 1/2019 | Cui | |
| D849,924 | S | 5/2019 | Sanders et al. | |
| 11,408,438 | B2 * | 8/2022 | Lofy | F04D 29/281 |
| 2001/0031137 | A1 * | 10/2001 | Jones-Lawlor | F04D 25/166 392/367 |
| 2004/0047743 | A1 | 3/2004 | Dooley et al. | |
| 2004/0244962 | A1 | 12/2004 | Tokunaga et al. | |
| 2005/0070220 | A1 | 3/2005 | Nagaya et al. | |
| 2006/0049615 | A1 | 3/2006 | Day | |
| 2009/0238687 | A1 | 9/2009 | Lin | |
| 2016/0175472 | A1 | 6/2016 | Tan | |
| 2017/0051748 | A1 | 2/2017 | He et al. | |
| 2018/0209432 | A1 | 7/2018 | Lee | |
| 2019/0128281 | A1 | 5/2019 | He et al. | |

FOREIGN PATENT DOCUMENTS

| | | |
|---|---|---|
| CN | 106225461 A | 12/2016 |
| CN | 107478047 A | 12/2017 |

OTHER PUBLICATIONS

STANLEY 655704 High Velocity Blower Fan, date posted unknown, site visited Jun. 29, 2019, Available from Internet.

* cited by examiner

HEATING BLOWER AND HEATING DEVICE

CROSS REFERENCE TO RELATED APPLICATION

This application claims priority to both Chinese Application No. 201811001080.7 having a filing date of Aug. 30, 2018 and Chinese Application No. 201811001086.4 having a filing date of Aug. 30, 2018, the entire contents of which are hereby incorporated by reference.

FIELD OF TECHNOLOGY

The following relates to the technical field of blowers, and in particular to a heating blower and a heating device.

BACKGROUND

A blower is a machine that sucks outside air to the interior of the machine through an air inlet and then blows it out from an air outlet. The blower usually has a volute-type body, with the air outlet close to the ground, and can be placed on the ground to dry a wet place. The conventional blower generally comprises a handle, an air duct, a motor and a wind wheel, wherein the air duct is in the shape of a volute; the motor and the wind wheel are disposed inside the air duct; and the air inlet and the air outlet are provided on a lateral side and a front end of the air duct respectively. To blow out warm air, the blower may also be provided with an electric heater therein. The electric heater is usually located inside the air duct, and the motor drives the wind wheel to rotate, so that an outgoing airflow passes through the electric heater and is heated thereby, and then blown out from the air outlet. However, in both a hot air blowing situation and a cold air blowing situation of the conventional blower, the path through which the airflow passes is the same, so that when it needs to blow cold air, the airflow also passes through the electric heater which is not power on, and as the electric heater is usually a metal net, the airflow will be blocked after passing through the metal net, resulting in a small amount of air coming out from the air outlet, and affecting the efficiency; in addition, since the electric heater is disposed in the air duct, the wall of the air duct is also heated during heating, so heat resistance is required for the entire air duct wall.

SUMMARY

Based on this, an objective of the present invention is to provide a heating blower, which has the advantage of switchable airflow path.

A heating blower, comprising an air duct, a motor and a wind wheel arranged in the air duct, and a heating device arranged at a first air outlet of the air duct; the wind wheel is fixed to a rotating shaft of the motor; the heating device comprises a housing, an electric heater and a moving assembly; the housing is sleeved on the first air outlet, forming an inner chamber, which comprises a first area facing directly to the first air outlet and a second area not facing directly to the first air outlet; the electric heater is arranged on the moving assembly, and moves between the first area and the second area along with the moving assembly, so that an airflow blown from the first air outlet switches between a state of passing the electric heater and a state of not passing the electric heater, and is blown out from a second air outlet provided at the housing.

Compared with the known art, in the present invention, the heating device is connected to the outside of the air outlet of the air duct of the blower, and by designing the positional relation between the electric heater and the air outlet of the air duct, an airflow blown from the air outlet of the air duct can switch between a state of passing the electric heater and a state of not passing the electric heater to achieve free switching between blowing hot air and blowing cold air; as compared with the case in which the heating device is arranged inside the air duct, the blower of the present invention can increase the air volume coming out from the air outlet of the air duct when blowing cold air, and can reduce the requirement of high temperature resistance for the overall material of the blower.

Further, the housing comprises a side wall and an end cover, the end cover being parallel to an end face of the first air outlet, one part of the end cover located in the first area being the second air outlet, and another part of the end cover located in the second area being a closed cover.

Further, the closed cover is located below the second air outlet.

Further, the heating device further comprises a guide rail and a handle, wherein the guide rail is arranged on the closed cover, and the handle is penetrated through the guide rail and is connected to the moving assembly. Preferably, the guide rail is on the closed cover and is vertically directed to the second air outlet, so that the handle can slide up and down along the guide rail, and drives the moving assembly to slide up and down together, thereby driving the electric heater to move between the first area and the second area.

Further, the moving assembly comprises a guide post and a guide sleeve seat sleeved on the guide post, wherein an end of the handle is connected to the guide sleeve seat, and the electric heater is arranged on the guide sleeve seat and moves with the guide sleeve seat along the guide post.

Further, a limiting part is provided on an inner wall of the closed cover of the end cover, and the limiting part abuts against the guide sleeve seat to fix position of the electric heater. Preferably, two limiting parts are provided on the inner wall of the closed cover of the end cover, for fixing the electric heater within the first area and the second area respectively.

In another embodiment, the moving assembly is a rotating shaft, the electric heater is arranged on the rotating shaft and rotates with the rotating shaft.

Further, the heating device further comprises a rotary button, which is arranged on the side wall and is connected to one end of the rotating shaft to drive the rotating shaft to rotate.

Further, a limiting part is provided on an inner wall of the side wall, and the limiting part abuts against the electric heater to fix position of the electric heater. Preferably, two limiting parts are provided on the inner wall of the side wall, for fixing the electric heater within the first area and the second area respectively.

Further, the heating device further comprises a micro switch connected in series with the electric heater, and the micro switch is arranged in the inner chamber; when the electric heater moves into the first area, the electric heater abuts against the micro switch, so that the micro switch is powered on; and when the electric heater moves into the second area, the electric heater does not abut against the micro switch, so that the micro switch is powered off. The micro switch is used for automatically switching the electric heater between an operation state and a non-operation state. When the micro switch is powered on, a separate power switch of the electric heater is turned on, and the electric heater starts operation; and when the micro switch is powered off, even if the separate power switch of the electric heater is still on, the electric heater does not operate.

The present invention also provides a heating device, comprising a housing, an electric heater and a moving assembly; the housing is sleeved on a first air outlet of an air duct of a blower, forming an inner chamber, which comprises a first area facing directly to the first air outlet and a second area not facing directly to the first air outlet; the electric heater is arranged on the moving assembly, and moves between the first area and the second area along with the moving assembly, so that an airflow blown from the first air outlet switches between a state of passing the electric heater and a state of not passing the electric heater, and is blown out from a second air outlet provided at the housing.

Further, the housing comprises a side wall and an end cover, the end cover being parallel to an end face of the first air outlet, one part of the end cover located in the first area being the second air outlet, and another part of the end cover located in the second area being a closed cover.

Further, the closed cover is located below the second air outlet.

Further, the heating device further comprises a guide rail and a handle, wherein the guide rail is arranged on the closed cover, and the handle is penetrated through the guide rail and is connected to the moving assembly. Preferably, the guide rail is on the closed cover and is vertically directed to the second air outlet, so that the handle can slide up and down along the guide rail, and drives the moving assembly to slide up and down together, thereby driving the electric heater to move between the first area and the second area.

Further, the moving assembly comprises a guide post and a guide sleeve seat sleeved on the guide post, wherein an end of the handle is connected to the guide sleeve seat, and the electric heater is arranged on the guide sleeve seat and moves with the guide sleeve seat along the guide post.

Further, a limiting part is provided on an inner wall of the closed cover of the end cover, and the limiting part abuts against the guide sleeve seat to fix position of the electric heater. Preferably, two limiting parts are provided on the inner wall of the closed cover of the end cover, for fixing the electric heater within the first area and the second area respectively.

In another embodiment, the moving assembly is a rotating shaft, the electric heater is arranged on the rotating shaft and rotates with the rotating shaft.

Further, the heating device further comprises a rotary button, which is arranged on the side wall and is connected to one end of the rotating shaft to drive the rotating shaft to rotate.

Further, a limiting part is provided on an inner wall of the side wall, and the limiting part abuts against the electric heater to fix position of the electric heater. Preferably, two limiting parts are provided on the inner wall of the side wall, for fixing the electric heater within the first area and the second area respectively.

Further, the heating device further comprises a micro switch connected in series with the electric heater, and the micro switch is arranged in the inner chamber; when the electric heater moves into the first area, the electric heater abuts against the micro switch, so that the micro switch is powered on; and when the electric heater moves into the second area, the electric heater does not abut against the micro switch, so that the micro switch is powered off.

BRIEF DESCRIPTION OF THE DRAWINGS

Some of the embodiments will be described in detail, with references to the following figures, wherein like designations denote like members, wherein.

DETAILED DESCRIPTION

Figure 1:
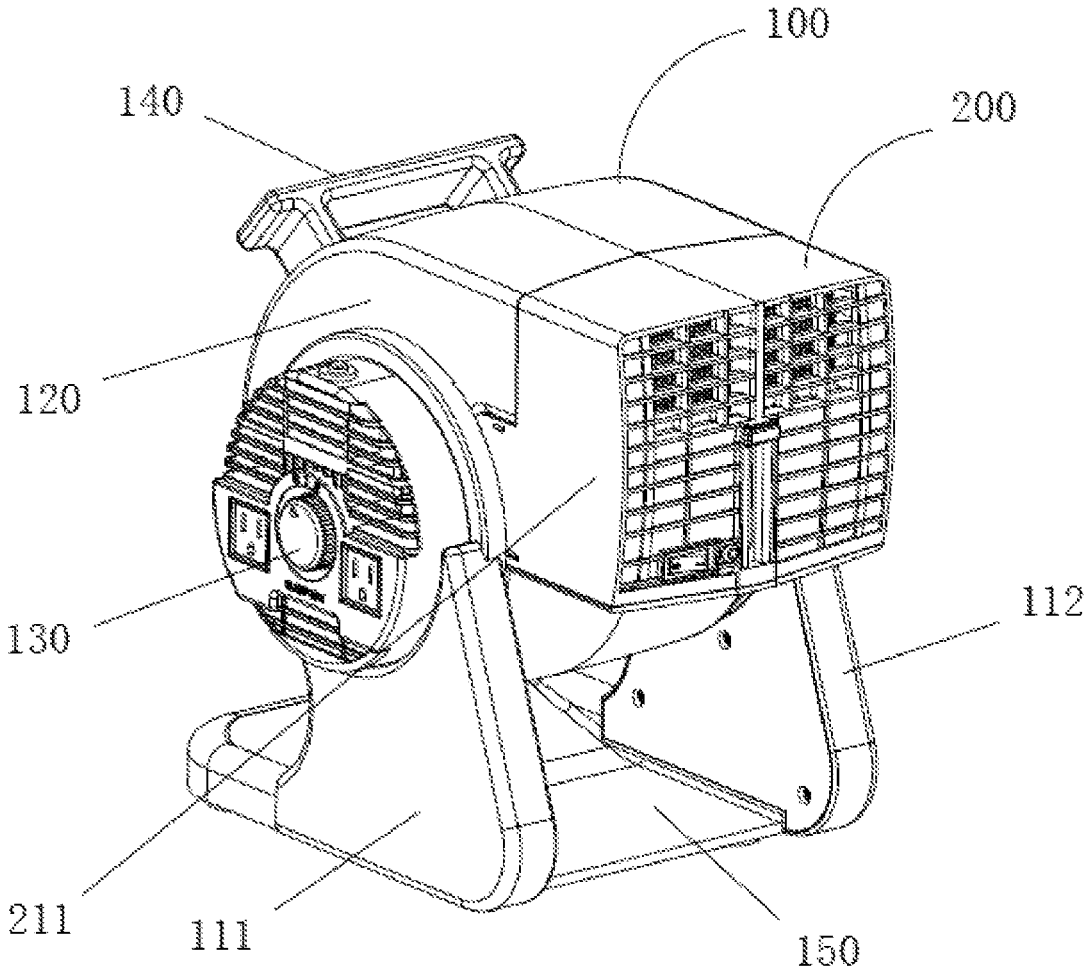
FIG. 1 is a stereoscopic structure diagram of a heating blower of embodiment 1.
Figure 2:
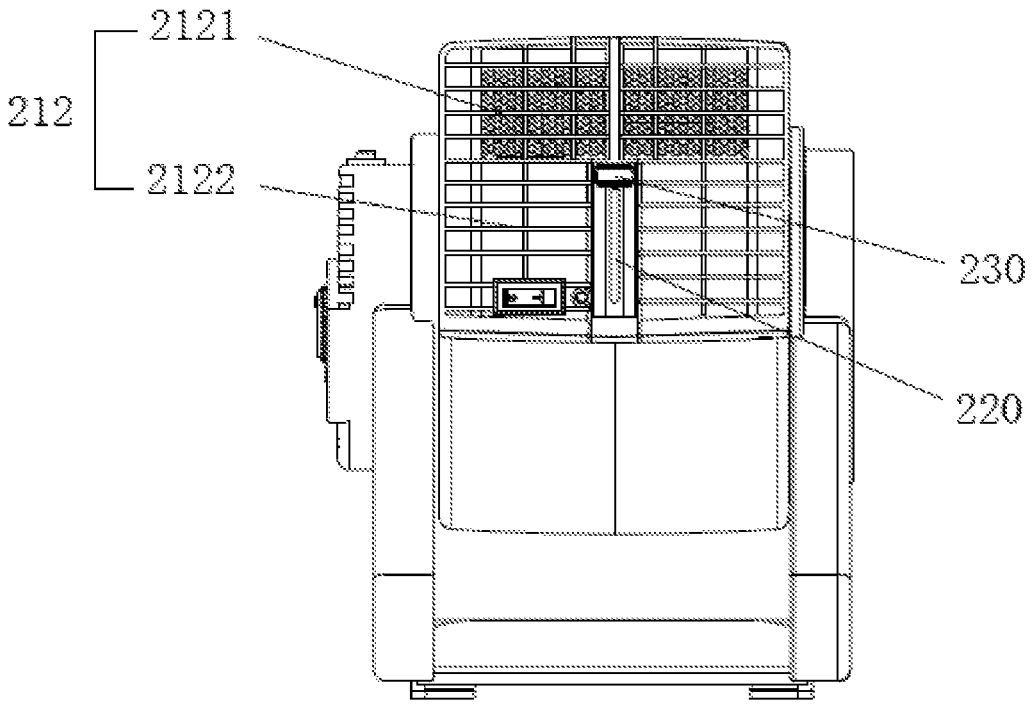
FIG. 2 is a front-view structure diagram of the heating blower of embodiment 1.
Figure 3:
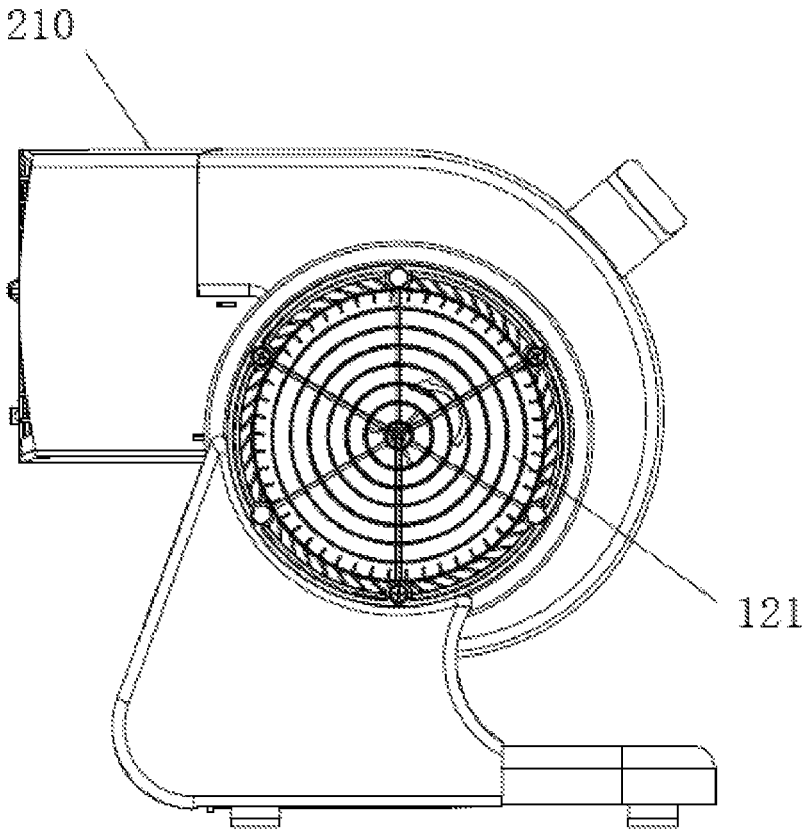
FIG. 3 is a right-view structure diagram of the heating blower of embodiment 1.
Figure 4:
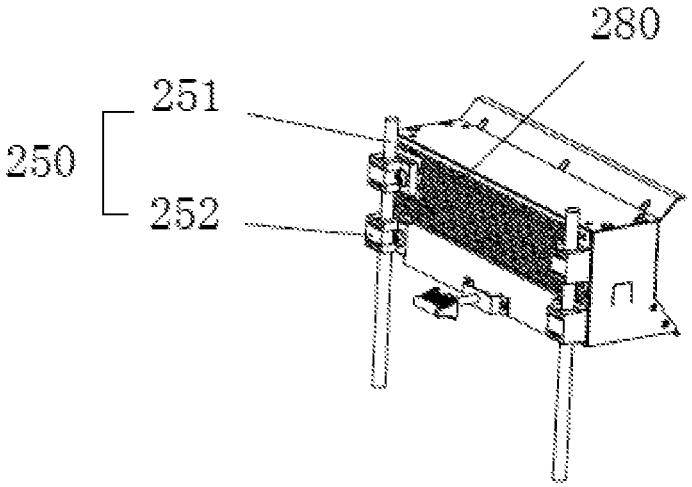
FIG. 4 is a structure diagram of some components of the heating blower of embodiment 1.

In the description of embodiments of the present invention, it is to be understood that the orientations or positional relationships, indicated by the terms "center", "longitudinal", "lateral", "upper", "lower", "front", "rear", "left", "right", "vertical", "horizontal", "top", "bottom", "inside", "outside" and the like, are based on the orientations or positional relationships shown in the drawings and are only for the purpose of facilitating and simplifying the description of embodiments of the present invention, rather than indicating or implying that the described device or element must have a particular orientation or must be constructed and operated in a particular orientation, and therefore they cannot to be construed as limiting embodiments of the present invention. In the description of embodiments of the present invention, the meaning of "a plurality of" is two or more, unless otherwise specified.

Embodiment 1

Refer to FIGS. 1 to 4, which shows a stereoscopic structure diagram, a front-view structure diagram, a right-view structure diagram, and a structure diagram of some components, of a heating blower of the embodiment, respectively.

The heating blower of the embodiment comprises a blower main body device 100 and a heating device 200. The heating device 200 is disposed outside the blower main body device 100.

The blower main body device 100 can adopt any blower main body structure disclosed in the known art. In this embodiment, it comprises a first side wall 111, a second side wall 112, an air duct 120, a motor, a wind wheel, a control assembly 130, a handle 140 and a bottom base 150. The first side wall 111 and the second side wall 112 are disposed oppositely in parallel to each other, and the air duct 120 is disposed between the first side wall 111 and the second side wall 112. Further preferably, the air duct 120 is rotatably disposed between the first sidewall 111 and the second sidewall 112, with the direction of the rotation axis being perpendicular to the first sidewall 111 and the second sidewall 112. The air duct 120 has a hollow volute shape, and comprises a body portion and a front end portion, wherein the motor is installed in the body portion, and the wind wheel is fixed on a rotating shaft of the motor (the motor and the wind wheel are not shown in the figures). The handle 140 is connected to the body portion. The bottom base 150 is arranged below air duct 120 with a distance from the air duct 120, and two sides of the bottom base 150 are connected to the bottoms of the first side wall 111 and the second side wall 112 respectively. The control assembly 130 is installed to a side face of the body portion, and is electrically connected to the motor. The control assembly 130 comprises a control panel and a rotary switch, an auxiliary power socket and a circuit protection device installed on the control panel. An air inlet 121 is provided at another side face of the body portion, and a first air outlet 122 is provided at the front end portion.

The heating device 200 is arranged at the first air outlet 122, and comprises a housing 210, a slide rail 220, a handle 230, an electric heater 240 and a moving assembly 250. The housing 210 is sleeved on the first air outlet 122 and forms an inner chamber, which comprises a first area 2101 facing directly to the first air outlet 122 and a second area 2102 not facing directly to the first air outlet 122. The electric heater 240 is fixedly arranged on the moving assembly 250, and moves between the first area 2101 and the second area 2102 along with the moving assembly 250, so that an airflow blown from the first air outlet 122 switches between a state of passing the electric heater 240 and a state of not passing the electric heater 240, and is blown out from a second air outlet provided at the housing 210.

The housing 210 comprises a side wall 211 and an end cover 212, the end cover 212 being parallel to an end face of the first air outlet 122, one part of the end cover 212 located in the first area 2101 being the second air outlet 2121, and another part of the end cover 212 located in the second area 2102 being a closed cover 2122. The guide rail 220 is arranged on the closed cover 2122, and the handle 230 is penetrated through the guide rail 220 and is connected to the moving assembly 250. Further preferably, the closed cover 2122 is located below the second air outlet 2121, and the guide rail 220 is on the closed cover 2122 and is vertically directed to the second air outlet 2121.

The moving assembly 250 comprises a guide post 251 and a guide sleeve seat 252 sleeved on the guide post 251, wherein an end of the handle 230 is connected to the guide sleeve seat 252, and the electric heater 240 is arranged on the guide sleeve seat 252 and moves with the guide sleeve seat 252 along the guide post 251.

A limiting part 260 is provided on an inner wall of the closed cover 2122 of the end cover, and the limiting part 260 is used for fixing the position of the electric heater 240. In the embodiment, the limiting part 260 comprises a first limit stop 261 and a second limit stop 262, wherein the first limit stop 261 is arranged on the inner wall of the top of the closed cover 2122 and is used for abutting against the guide sleeve seat 252 to fix the electric heater 240 within the first area 2101; and the second limit stop 262 is arranged on the inner wall of the bottom of the closed cover 2122 and is used for abutting against the guide sleeve seat 252 to fix the electric heater 240 within the second area 2102.

The heating device 200 further comprises a micro switch 270 connected in series with the electric heater 240, and the micro switch 270 is arranged in the inner chamber. In the embodiment, the micro switch 270 is provided with an elastic sheet. When the electric heater 240 moves into the first area 2101, the electric heater 240 comes into contact with and presses the elastic sheet of the micro switch 270, so that the micro switch 270 is powered on, and when the electric heater 240 moves into the second area 2102, the elastic sheet bounces up, so that the micro switch 270 is powered off.

The heating device 200 further comprises a protective net 280 disposed in the inner chamber and mounted on the electric heater 240.

Figure 5:
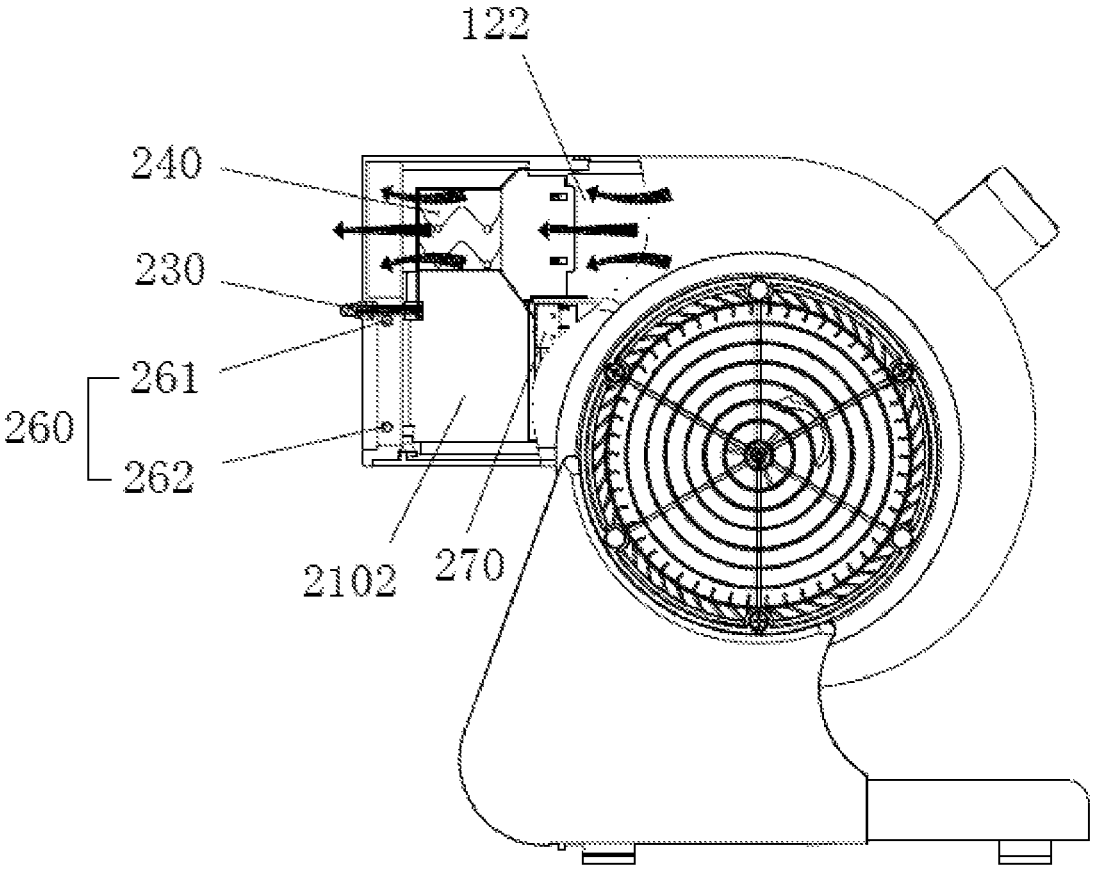
FIG. 5 is a schematic diagram of the heating blower of embodiment 1 in a heating state during operation.
Figure 6:
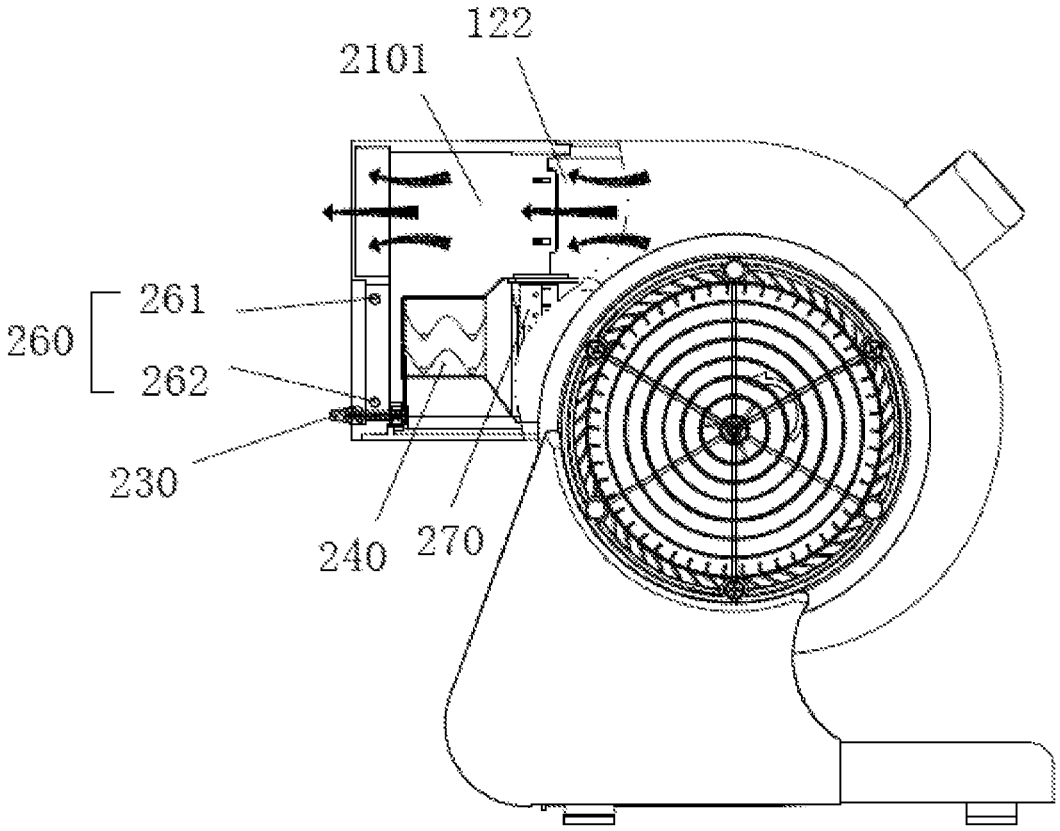
FIG. 6 is a schematic diagram of the heating blower of embodiment 1 in a normal state during operation.
Figure 7:
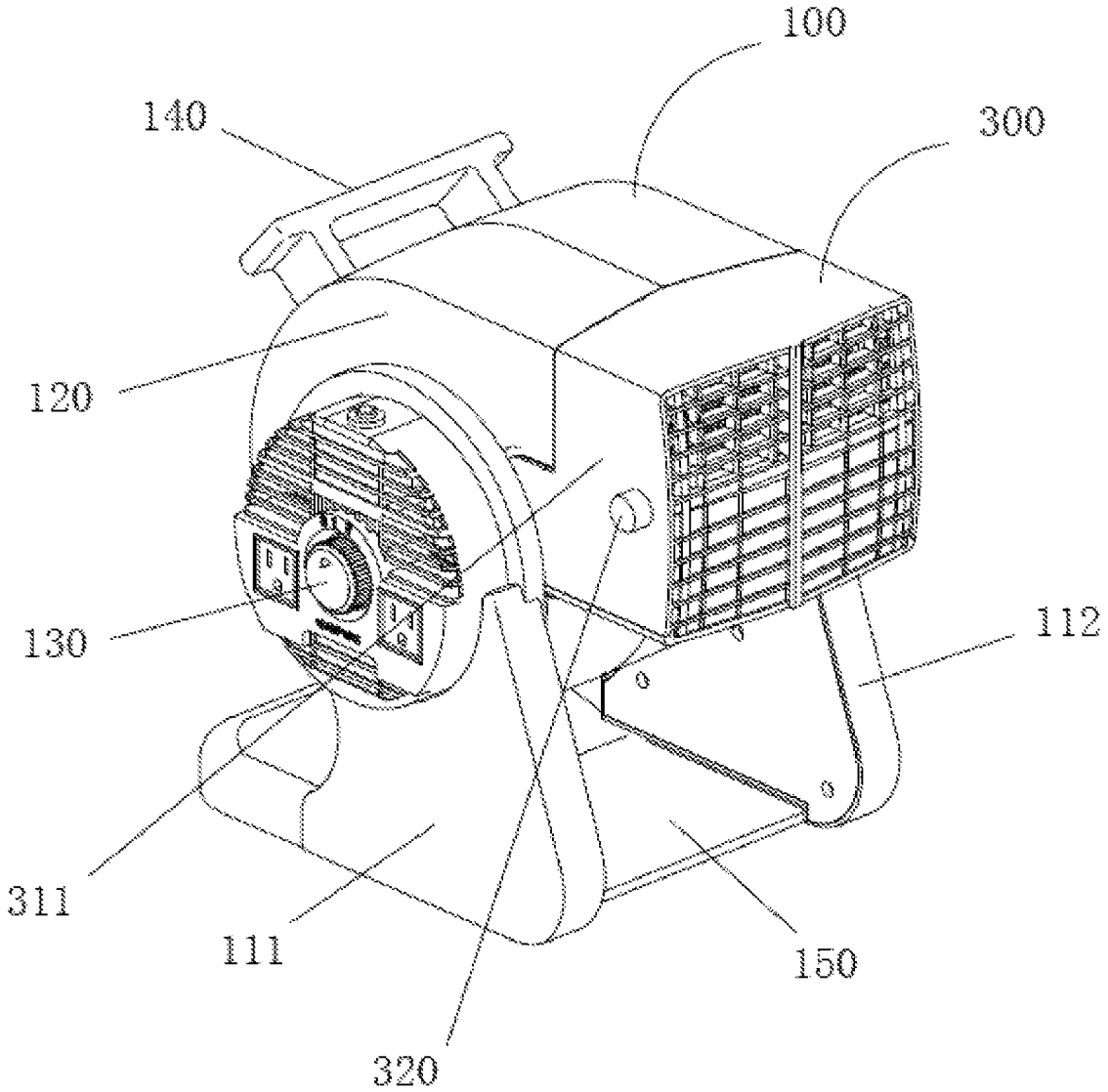
FIG. 7 is a stereoscopic structure diagram of a heating blower of embodiment 2.
Figure 8:
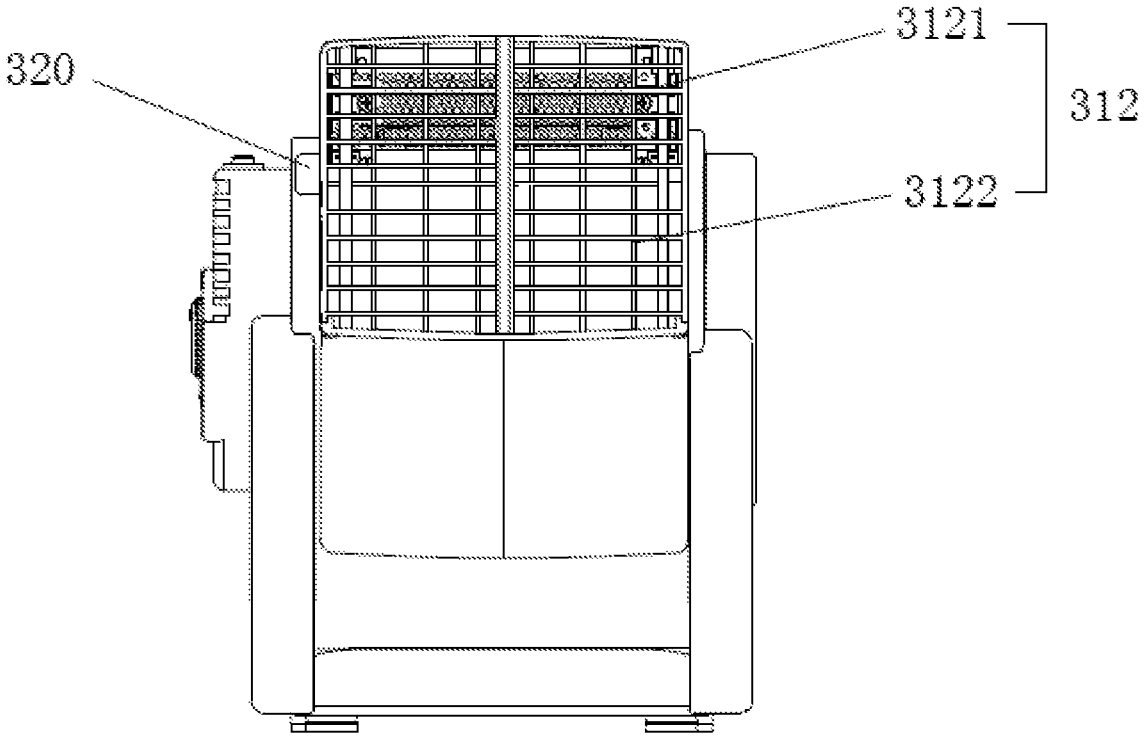
FIG. 8 is a front-view structure diagram of the heating blower of embodiment 2.
Figure 9:
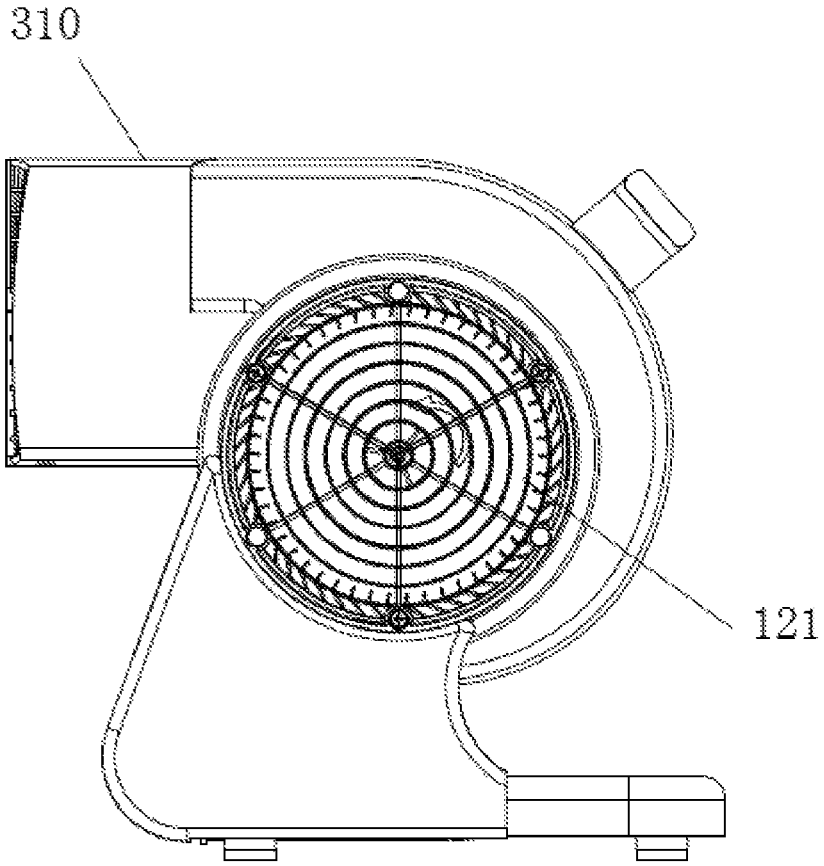
FIG. 9 is a right-view structure diagram of the heating blower of embodiment 2.
Figure 10:
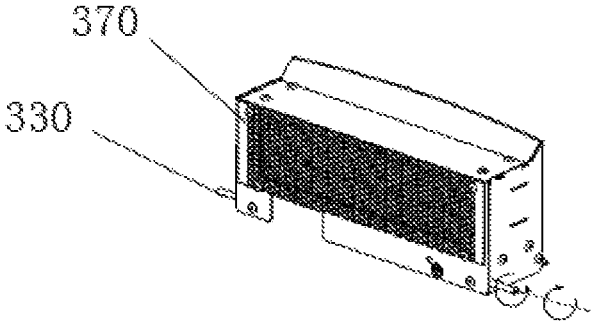
FIG. 10 is a structure diagram of some components of the heating blower of embodiment 2.

Refer to both FIG. 5 and FIG. 6, which shows a schematic diagram of the heating blower of the embodiment in a heating state during operation and a schematic diagram of the heating blower in a normal state during operation, respectively. In the heating state, the electric heater 240, driven by the handle 230, slides upward along the guide post 251 into the first area 2101, and the first limit stop 261 abuts against the guide sleeve seat 252 and fixes the electric heater 240 within the first area 2101, and at that time, the micro switch 270 is powered on, and a separate power switch of the electric heater 240 is turned on, the electric heater 240 starts operation, the airflow blown from the first air outlet 122 passes through the electric heater 240 and is heated thereby, and then hot air is blown from the second air outlet 2121. In the normal state, the electric heater 240, driven by the handle 230, slides downward along the guide post 251 into the second area 2102, and the second limit stop 262 abuts against the guide sleeve seat 252 and fixes the electric heater 240 within the second area 2102, and at that time, the micro switch 270 is powered off, and even if the separate power switch of the electric heater is still on, the electric heater 240 does not operate, the airflow blown from the first air outlet 122 is not heated by the electric heater 240 and directly passes through the first area 2101, and then cold air is blown from the second air outlet 2121, wherein the cold air here refers to room-temperature air. Thus, the operation state and the non-operation state of the electric heater can be switched by the micro switch.

Embodiment 2

Refer to FIGS. 7 to 10, which shows a stereoscopic structure diagram, a front-view structure diagram, a right-view structure diagram, and a structure diagram of some components, of a heating blower of the embodiment, respectively.

The heating blower of the embodiment comprises a blower main body device 100 and a heating device 300. The heating device 300 is disposed outside the blower main body device 100.

The blower main body device 100 can adopt any blower main body structure disclosed in the known art. In this embodiment, it comprises a first side wall 111, a second side wall 112, an air duct 120, a motor, a wind wheel, a control assembly 130, a handle 140 and a bottom base 150. The first side wall 111 and the second side wall 112 are disposed oppositely in parallel to each other, and the air duct 120 is disposed between the first side wall 111 and the second side wall 112. Further preferably, the air duct 120 is rotatably disposed between the first sidewall 111 and the second sidewall 112, with the direction of the rotation axis being perpendicular to the first sidewall 111 and the second sidewall 112. The air duct 120 has a hollow volute shape, and comprises a body portion and a front end portion, wherein the motor is installed in the body portion, and the wind wheel is fixed on a rotating shaft of the motor (the motor and the wind wheel are not shown in the figures). The handle 140 is connected to the body portion. The bottom base 150 is arranged below air duct 120 with a distance from the air duct 120, and two sides of the bottom base 150 are connected to the bottoms of the first side wall 111 and the second side wall 112 respectively. The control assembly 130 is installed to a side face of the body portion, and is electrically connected to the motor. The control assembly 130 comprises a control panel and a rotary switch, an auxiliary power socket and a circuit protection device installed on the control panel. An air inlet 121 is provided at another side face of the body portion, and a first air outlet 122 is provided at the front end portion.

The heating device 300 is arranged at the first air outlet 122, and comprises a housing 310, a rotary button 320, a rotary assembly 330 and an electric heater 340. The housing 310 is sleeved on the first air outlet 122 and forms an inner chamber, which comprises a first area 3101 facing directly to the first air outlet 122 and a second area 3102 not facing directly to the first air outlet 122. The electric heater 340 is fixedly arranged on the rotary assembly 330, and rotates between the first area 3101 and the second area 3102 along with the rotary assembly 330, so that an airflow blown from the first air outlet 122 switches between a state of passing the electric heater 340 and a state of not passing the electric heater 340, and is blown out from a second air outlet provided at the housing 310.

The housing 310 comprises a side wall 311 and an end cover 312, the end cover 312 being parallel to an end face of the first air outlet 122, one part of the end cover 312 located in the first area 3101 being the second air outlet 3121, and another part of the end cover 312 located in the second area 3102 being a closed cover 3122. The rotary button 320 is arranged on the side wall 311, and the rotary assembly 330 is a rotating shaft and is connected to the rotary button 320 at one end. Further preferably, the closed cover 3122 is located below the second air outlet 3121.

A limiting part 350 is provided on inner walls of the side wall 311 and the closed cover 3122 of the end cover, and the limiting part 350 abuts against the electric heater 340 to fix the position thereof. In the embodiment, the limiting part 350 comprises a first limit stop 351 and a second limit stop 352, wherein the first limit stop 351 is arranged on the inner wall of the top of the side wall 311 and is used for abutting against the electric heater 340 to fix the electric heater within the first area 3101; and the second limit stop 352 is arranged on the inner wall of the side wall 311 close to the bottom and is used for abutting against the electric heater 340 to fix the electric heater 340 within the second area 3102.

The heating device 300 further comprises a micro switch 360 connected in series with the electric heater 340, and the micro switch 360 is arranged in the inner chamber. In the embodiment, the micro switch 360 is provided with an elastic sheet. When the electric heater 340 rotates into the first area 3101, the electric heater 340 comes into contact with and presses the elastic sheet of the micro switch 360, so that the micro switch 360 is powered on, and when the electric heater 340 rotates into the second area 3102, the elastic sheet bounces up, so that the micro switch 360 is powered off.

The heating device 300 further comprises a protective net 370 disposed in the inner chamber and mounted on the electric heater 340.

Figure 11:
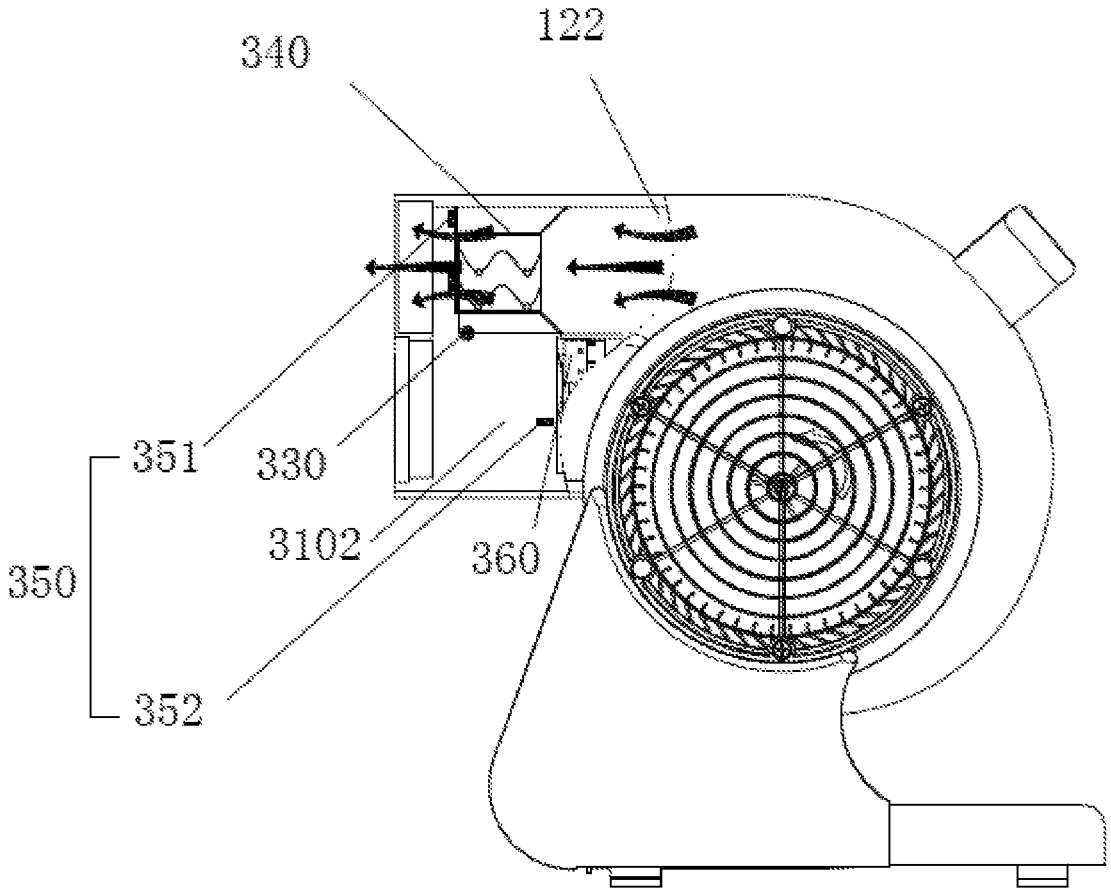
FIG. 11 is a schematic diagram of the heating blower of embodiment 2 in a heating state during operation.
Figure 12:
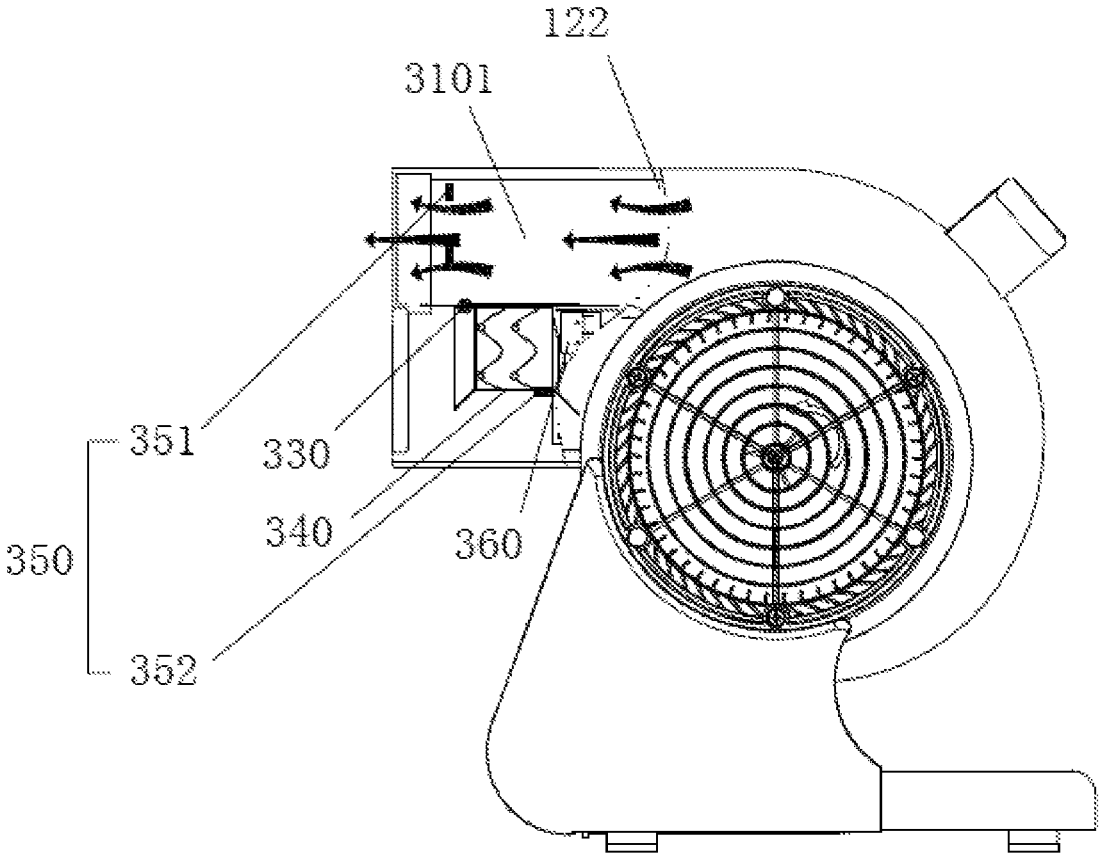
FIG. 12 is a schematic diagram of the heating blower of embodiment 2 in a normal state during operation.

Refer to both FIG. 11 and FIG. 12, which shows a schematic diagram of the heating blower of the embodiment in a heating state during operation and a schematic diagram of the heating blower in a normal state during operation, respectively. In the heating state, the electric heater 340, driven by the rotary button 320, rotates upward with a rotating shaft 330 into the first area 3101, and the first limit stop 351 abuts against the electric heater 340 to fix the electric heater within the first area 3101, and at that time, the micro switch 360 is powered on, and a separate power switch of the electric heater 340 is turned on, the electric heater 340 starts operation, the airflow blown from the first air outlet 122 passes through the electric heater 340 and is heated thereby, and then hot air is blown from the second air outlet 3121. In the normal state, the electric heater 340, driven by the rotary button 320, rotates downward with the rotating shaft 330 into the second area 3102, and the second limit stop 352 abuts against the electric heater 340 to fix the electric heater within the second area 3102, and at that time, the micro switch 360 is powered off, and even if the separate power switch of the electric heater is still on, the electric heater 340 does not operate, the airflow blown from the first air outlet 122 is not heated by the electric heater 340 and directly passes through the first area 3101, and then cold air is blown from the second air outlet 3121, wherein the cold air here refers to room-temperature air. Thus, the operation state and the non-operation state of the electric heater can be switched by the micro switch.

Compared with the known art, in the present invention, the heating device is connected to the outside of the air outlet of the air duct of the blower, and by designing the positional relation between the electric heater and the air outlet of the air duct, an airflow blown from the air outlet of the air duct can switch between a state of passing the electric heater and a state of not passing the electric heater to achieve free switching between blowing hot air and blowing cold air; as compared with the case in which the heating device is arranged inside the air duct, the blower of the present invention can increase the air volume coming out from the air outlet of the air duct when blowing cold air, and can reduce the requirement of high temperature resistance for the overall material of the blower.

Although the invention has been illustrated and described in greater detail with reference to the preferred exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

What is claimed is:

1. A heating blower, comprising an air duct, a motor and a wind wheel arranged in the air duct, and a heating device arranged at a first air outlet of the air duct; the wind wheel is fixed to a rotating shaft of the motor; the heating device comprises a housing, an electric heater and a moving assembly; the housing is sleeved on the first air outlet, forming an inner chamber, which comprises a first area facing directly to the first air outlet and a second area not facing directly to the first air outlet; the electric heater is arranged on the moving assembly, and moves between the first area and the second area along with the moving assembly, so that an airflow blown from the first air outlet switches between a state of passing the electric heater and a state of not passing the electric heater, and is blown out from a second air outlet provided at the housing.

2. The heating blower according to claim 1, wherein the housing comprises a side wall and an end cover, the end cover being parallel to an end face of the first air outlet, one part of the end cover located in the first area being the second air outlet, and another part of the end cover located in the second area being a closed cover.

3. The heating blower according to claim 2, wherein the closed cover is located below the second air outlet.

4. The heating blower according to claim 2, wherein the heating device further comprises a guide rail and a handle, wherein the guide rail is arranged on the closed cover, and the handle is penetrated through the guide rail and is connected to the moving assembly.

5. The heating blower according to claim 4, wherein the moving assembly comprises a guide post and a guide sleeve seat sleeved on the guide post, wherein an end of the handle is connected to the guide sleeve seat, and the electric heater is arranged on the guide sleeve seat and moves with the guide sleeve seat along the guide post.

6. The heating blower according to claim 2, wherein the moving assembly is a rotating shaft, the electric heater is arranged on the rotating shaft and rotates with the rotating shaft.

7. The heating blower according to claim 6, wherein the heating device further comprises a rotary button, which is arranged on the side wall and is connected to one end of the rotating shaft to drive the rotating shaft to rotate.

8. The heating blower according to claim 5, wherein a limiting part is provided on an inner wall of the closed cover of the end cover, and the limiting part abuts against the guide sleeve seat to fix position of the electric heater.

9. The heating blower according to claim 6, wherein a limiting part is provided on an inner wall of the side wall, and the limiting part abuts against the electric heater to fix position of the electric heater.

10. The heating blower according to claim 2, wherein the heating device further comprises a micro switch connected in series with the electric heater, and the micro switch is arranged in the inner chamber; when the electric heater moves into the first area, the electric heater abuts against the micro switch, so that the micro switch is powered on; and when the electric heater moves into the second area, the electric heater does not abut against the micro switch, so that the micro switch is powered off.

11. A heating device, comprising a housing, an electric heater and a moving assembly; the housing is sleeved on a first air outlet of an air duct of a blower, forming an inner chamber, which comprises a first area facing directly to the first air outlet and a second area not facing directly to the first air outlet; the electric heater is arranged on the moving assembly, and moves between the first area and the second area along with the moving assembly, so that an airflow blown from the first air outlet switches between a state of passing the electric heater and a state of not passing the electric heater, and is blown out from a second air outlet provided at the housing.

12. The heating device according to claim 11, wherein the housing comprises a side wall and an end cover, the end cover being parallel to an end face of the first air outlet, one part of the end cover located in the first area being the second air outlet, and another part of the end cover located in the second area being a closed cover.

13. The heating device according to claim 12, wherein the closed cover is located below the second air outlet.

14. The heating device according to claim 12, further comprising a guide rail and a handle, wherein the guide rail is arranged on the closed cover, and the handle is penetrated through the guide rail and is connected to the moving assembly.

15. The heating device according to claim 14, wherein the moving assembly comprises a guide post and a guide sleeve seat sleeved on the guide post, wherein an end of the handle is connected to the guide sleeve seat, and the electric heater is arranged on the guide sleeve seat and moves with the guide sleeve seat along the guide post.

16. The heating device according to claim 12, wherein the moving assembly is a rotating shaft, the electric heater is arranged on the rotating shaft and rotates with the rotating shaft.

17. The heating device according to claim 16, further comprising a rotary button, which is arranged on the side wall and is connected to one end of the rotating shaft to drive the rotating shaft to rotate.

18. The heating device according to claim 15, wherein a limiting part is provided on an inner wall of the closed cover of the end cover, and the limiting part abuts against the guide sleeve seat to fix position of the electric heater.

19. The heating device according to claim 16, wherein a limiting part is provided on an inner wall of the side wall, and the limiting part abuts against the electric heater to fix position of the electric heater.

20. The heating device according to claim 12, further comprising a micro switch connected in series with the electric heater, wherein the micro switch is arranged in the inner chamber; when the electric heater moves into the first area, the electric heater abuts against the micro switch, so that the micro switch is powered on; and when the electric heater moves into the second area, the electric heater does not abut against the micro switch, so that the micro switch is powered off.

* * * * *